US011629548B2

(12) United States Patent
Veronika

(10) Patent No.: US 11,629,548 B2
(45) Date of Patent: Apr. 18, 2023

(54) PET DOOR APPARATUS

(71) Applicant: Kristian Veronika, Burleigh Heads (AU)

(72) Inventor: Kristian Veronika, Burleigh Heads (AU)

( * ) Notice: Subject to any disclaimer, the term of this patent is extended or adjusted under 35 U.S.C. 154(b) by 177 days.

(21) Appl. No.: 17/121,819

(22) Filed: Dec. 15, 2020

(65) Prior Publication Data

US 2021/0180376 A1 Jun. 17, 2021

(30) Foreign Application Priority Data

Dec. 16, 2019 (AU) ..... 2019904758

(51) Int. Cl.
*E06B 7/32* (2006.01)
*E05C 19/16* (2006.01)
*E06B 7/21* (2006.01)

(52) U.S. Cl.
CPC ..... *E06B 7/32* (2013.01); *E05C 19/16* (2013.01); *E06B 7/21* (2013.01)

(58) Field of Classification Search
CPC ..... E06B 7/32; E05C 19/16
See application file for complete search history.

(56) References Cited

U.S. PATENT DOCUMENTS 2,693,382 A * 11/1954 Teetor ..... E05C 19/16 292/251.5
2,778,417 A * 1/1957 Novitz ..... E06B 7/32 160/354
2,839,791 A * 6/1958 Lee ..... E06B 7/32 49/386
4,408,416 A * 10/1983 Davlantes ..... E06B 7/32 160/90
4,754,797 A * 7/1988 Sronce ..... E06B 7/32 160/354
4,776,133 A * 10/1988 Green ..... E06B 7/32 49/169

(Continued)

FOREIGN PATENT DOCUMENTS

EP 3446910 A1 * 2/2019 ..... B60K 15/05
GB 2223049 A * 3/1990 ..... E06B 7/32
KR 20150054101 A * 10/2015

OTHER PUBLICATIONS

Machine translation of KR_20150054101_A_I.*

*Primary Examiner* — Marcus Menezes
(74) *Attorney, Agent, or Firm* — Mark M. Friedman

(57) ABSTRACT

A pet door apparatus (10) discloses a pet door frame (12), an opening (34), and closure flap (36) which is rotatable for at least partly closing the opening or extending away from the opening. A magnet (102) and magnetically attractable element are respectively on one or the other of the flap and frame, and an actuator can move the magnet or magnetically attractable element to change the distance, and magnetic attraction force, between them. A blocking member (176) attached to a side part (28) of the frame is movable under gravitational force and due to engaging cam surfaces (196, 198), from an extended, raised position for partially closing a gap (160) between the flap and frame, to a retracted, lowered position, and back to the raised, extended position by magnetic attraction between a magnet (164) on the flap and another magnet (190) on the frame.

17 Claims, 13 Drawing Sheets

(56) References Cited

U.S. PATENT DOCUMENTS

| | | | | |
|---|---|---|---|---|
| 5,269,097 | A * | 12/1993 | Davlantes | E05C 9/00 49/169 |
| 8,484,896 | B1 * | 7/2013 | Skubiak, Jr. | E06B 9/52 160/369 |
| 2005/0066578 | A1 * | 3/2005 | Vaccari | E06B 7/32 49/169 |
| 2006/0006674 | A1 * | 1/2006 | Kang | G06F 1/1616 292/251.5 |
| 2008/0184625 | A1 * | 8/2008 | Bjorholm | E06B 7/32 119/416 |
| 2009/0255481 | A1 * | 10/2009 | Bosserdet, Jr. | E06B 7/32 119/484 |
| 2017/0260799 | A1 * | 9/2017 | Siller | E06B 7/18 |
| 2018/0195326 | A1 * | 7/2018 | Mainini | E06B 7/32 |
| 2018/0263213 | A1 * | 9/2018 | Ralli | A61D 7/00 |
| 2019/0069508 | A1 * | 3/2019 | Stricklin | E05B 47/0012 |
| 2019/0203527 | A1 * | 7/2019 | Stricklin | E06B 7/32 |
| 2020/0224489 | A1 * | 7/2020 | Chiodo | E06B 7/32 |
| 2021/0144956 | A1 * | 5/2021 | Bohannon | A01K 27/001 |

* cited by examiner

PET DOOR APPARATUS

FIELD OF THE INVENTION

The present invention relates to pet doors. More specifically, aspects of the invention relate to pet door apparatuses.

BACKGROUND TO THE INVENTION

It is known to install pet doors in normal doors and windows that provide access to spaces such as rooms in homes, for allowing pet animals, such as dogs and cats, to enter or exit such spaces without the need for human intervention. Typically, such pet doors are installed in normal doors or windows such as wooden or glass access doors or windows, or adjacent to closures such as sliding doors or sliding windows.

An example of a known pet door apparatus involves a pet door insert panel for use with sliding door systems. Such a panel can be installed in a corner of the sliding door frame where it can be abutted by a sliding pane of the sliding door system.

A typical pet door is installed in an aperture in the main access door, and defines its own opening, and has a flap which is movable between a closed position in which it closes that opening and an open position in which the opening is opened, so that a pet can move through the pet door.

The flap is typically freely movable, to allow the pet, itself, to push the flap in order to move through the opening of the pet door.

It is also known to use means such as magnets, to assist the flap to stay in its closed position, so that it does not open undesirably, such as under the effect of gusts of wind.

It is desirable in such pet doors to be able to change the magnetic force to suit the needs of pets having different strengths, or to accommodate different environments, for example those having different strengths of prevailing winds, and so on.

One known such pet door involves the use of a magnet on a frame of the door, with a magnetically attractable clip on the flap, where the magnetic force exerted by the magnet on the flap can be modified by changing the position of the clip relative to the magnet. However, such doors have the disadvantage that the clips are secured to the material of which the flaps are made by teeth or the like, so that movement of the clip can cause damage to that flap material. In addition, such clips are inconvenient to use.

Another problem with known pet doors is that there may be small gaps between the flaps of the doors and the pet door frames on which the flaps are supported, which can allow air, for example under the effect of wind, to pass through the pet doors.

A known pet door apparatus that seeks to address this issue involves the use of a movable element located on a frame of the pet door which can be moved into a position to close the gap. One of the potential problems of having such a movable element is that when the movable element is in its gap-closing position with the flap opened, and the flap is moved towards its closed position, the flap can collide with the movable element and thus be prevented from closing.

Accordingly, this known type of pet door apparatus may be provided with a spring that urges the movable element in a direction away from the flap, and magnets (or a magnet and a magnetically attractable element) which apply magnetic force to the element which can overcome the force of the spring when the magnets (or magnet and magnetically attractable element) are close enough to each other, that is, when the pet flap is in a closed position. This can to draw the movable element towards the flap to at least partially close the gap.

When the flap is moved to its open position the magnetic attraction forces decrease enabling the spring to retract the movable element.

However, a disadvantage of such a known pet door relates to the need to add the springs to the pet door construction. The requirement to design the pet door with suitable springs may involve the need to select suitable spring sizes and stiffnesses to function in relation to the magnetic forces that are applied, thereby contributing to difficulties/complexity of design and complications in manufacture.

Indeed, for the springs to function in relation to the magnetic forces, the springs may need to be weak which can make them susceptible to breakage. In addition, extra components may be required for attachment of the springs—one side of each spring to the movable element and the other side to the inside of the frame. These issues also can add to the cost of the springs and of the pet doors.

It is an object of the present invention to overcome or ameliorate disadvantages of the prior art, or to provide a useful alternative thereto.

SUMMARY OF THE INVENTION

According to a first aspect of the invention there is provided a pet door apparatus including:

a pet door frame defining a pet door opening;

a closure flap rotatably mounted on the pet door frame, the closure flap being rotatable between a closed position in which the flap closes at least part of the pet door opening and an open position in which the closure flap is at least partly spaced from the pet door opening;

a magnet;

a magnetically attractable element; and an actuator, wherein the magnet is mounted on one of the closure flap and the pet door frame and the magnetically attractable element is mounted on the other of the closure flap and the pet door frame wherein the magnet and magnetically attractable element are adapted to exert a magnetic attraction force on each other when the closure flap is in its closed position, wherein one of the magnet and magnetically attractable element is movable by the actuator, relative to the one or other of the closure flap and the pet door frame to which it is mounted, whereby, said one of the magnet and magnetically attractable element is moveable by the actuator relative to the other of said magnet and magnetically attractable element while the closure flap remains in its closed position, so as to change the distance between the magnet and magnetically attractable element and thereby to change the magnetic attraction force.

In a preferred embodiment of the invention, said actuator is a linear actuator adapted to move said one of the magnet and magnetically attractable element linearly.

Then, preferably, the linear actuator includes a shaft having a first screw thread, and a nut formation having a second screw thread complementary to the first screw thread and said one of the magnet and magnetically attractable element is mounted to the shaft via the nut formation, whereby rotation of the shaft is adapted to cause relative rotation between the first screw thread and second screw thread thereby causing linear movement of the nut formation and said one of the magnet and magnetically attractable element along the shaft such that said one of the magnet and magnetically attractable element moves relative to the other of the magnet and magnetically attractable element when the closure flap is in its closed position.

In a preferred embodiment of the invention, the apparatus includes an actuator controller adapted to cause movement of at least a part of actuator to effect movement of said one of the magnet and magnetically attractable element.

Preferably, said at least a part of the actuator includes the nut formation, and the actuator controller is adapted to cause movement of the nut formation along the shaft to effect said movement of said one of the magnet and magnetically attractable element.

Preferably, the controller is manually operable.

Then, preferably, the controller is manually operable by means of a manually operable tool applied to the controller.

In a preferred embodiment of the invention, the apparatus includes an indicator device for providing a visual indication which represents a relative positioning between said one of the magnet and magnetically attractable element and other of the magnet and magnetically attractable element.

According to a second aspect of the invention there is provided a pet door apparatus including:

a pet door frame defining a pet door opening, the frame having a side frame component;

a flap rotatably mounted on the pet door frame, the flap being rotatable between a closed position in which the flap closes at least part of the pet door opening such that there is a gap between the flap and the side frame component, and an open position in which the flap is at least partly spaced from the pet door opening;

a blocking member attached to the side frame component so as to be movable relative to the side frame component between in extended position in which at least a portion of the gap is closed by the blocking member, and wherein the blocking member is in a vertically upper position, and a retracted position in which less than said portion of the gap is closed by the blocking member, and wherein the blocking member is in a vertically lower position, the blocking member being adapted to move from the vertically lower position to the vertically upper position when moving from the retracted position to the extended position and to move from the vertically upper position to the vertically lower position when moving from the extended position to the retracted position, wherein gravitational force urges the blocking member towards its vertically lower position so as to urge the blocking member towards its retracted position;

a magnet;

a magnetically attractable element; and wherein the magnet is mounted to a first portion of the pet door apparatus and the magnetically attractable element is mounted to a second portion of the pet door apparatus, wherein one of the first portion and second portion is on the flap adjacent to the gap when the flap is in the closed position, and the other of the first portion and second portion is on the side frame component adjacent to the gap, wherein, when the flap is moved into in the closed position, the magnet and the magnetically attractable element are adapted for a first magnetic attraction force to be exerted between them, the first magnetic attraction force being sufficient to overcome the urging of the blocking member towards its vertically lower, retracted position by said gravitational force, thereby to cause the blocking member to move from its vertically lower position to its vertically upper position and from its retracted position towards its extended position, and wherein, when the flap is in its open position, the magnet and the magnetically attractable element are adapted for at most a second magnetic attraction force to be exerted between them, the second magnetic attraction force being less than the first magnetic attraction force, and being insufficient to overcome the urging of the blocking member towards is vertically lower, retracted position by said gravitational force, whereby the blocking member is adapted for said gravitational force to move the blocking member towards its vertically lower, retracted position.

In a preferred embodiment of the invention, the side frame component includes a first cam surface and the blocking member includes a second cam surface, said cam surface being adapted, when the first magnetic attraction force causes the blocking member to move from its lower vertical position and retracted position towards its upper vertical position and extended position, for the second cam surface to ride along the first cam surface thereby to cause said the blocking member to undergo upward movement from the lower vertical position towards the upper vertical position.

In a preferred embodiment of the invention, when, when the blocking member is in the extended position, substantially the whole of the gap is closed by the blocking member.

In a preferred embodiment of the invention, when the blocking member is in the retracted position, substantially no portion of the gap is closed by the blocking member.

In a preferred embodiment of the invention, the blocking member is elongate and the second cam surface is disposed adjacent to a lower end of the blocking member.

In a preferred embodiment of the invention, the side frame component includes a support formation positioned below the blocking member and on which the blocking member is disposed, the support formation defining the first cam surface.

In a preferred embodiment of the invention, the blocking member has a base portion and a protruding portion and the side frame component defines a slot, wherein the blocking member, when in its extended position, is adapted for the protruding portion to protrude from the slot into the gap by a first length, and is adapted for the protruding portion to be retracted relative to the first length when the blocking portion is in its retracted position.

According to an embodiment of the invention, the magnetically attractable element is a magnet, and according to an embodiment of the invention, the magnetically attractable element is a magnet.

BRIEF DESCRIPTION OF THE DRAWINGS

Preferred embodiments of the invention will now be described, by way of example only, with reference to the accompanying drawings in which.

DETAILED DESCRIPTION

Figure 1:
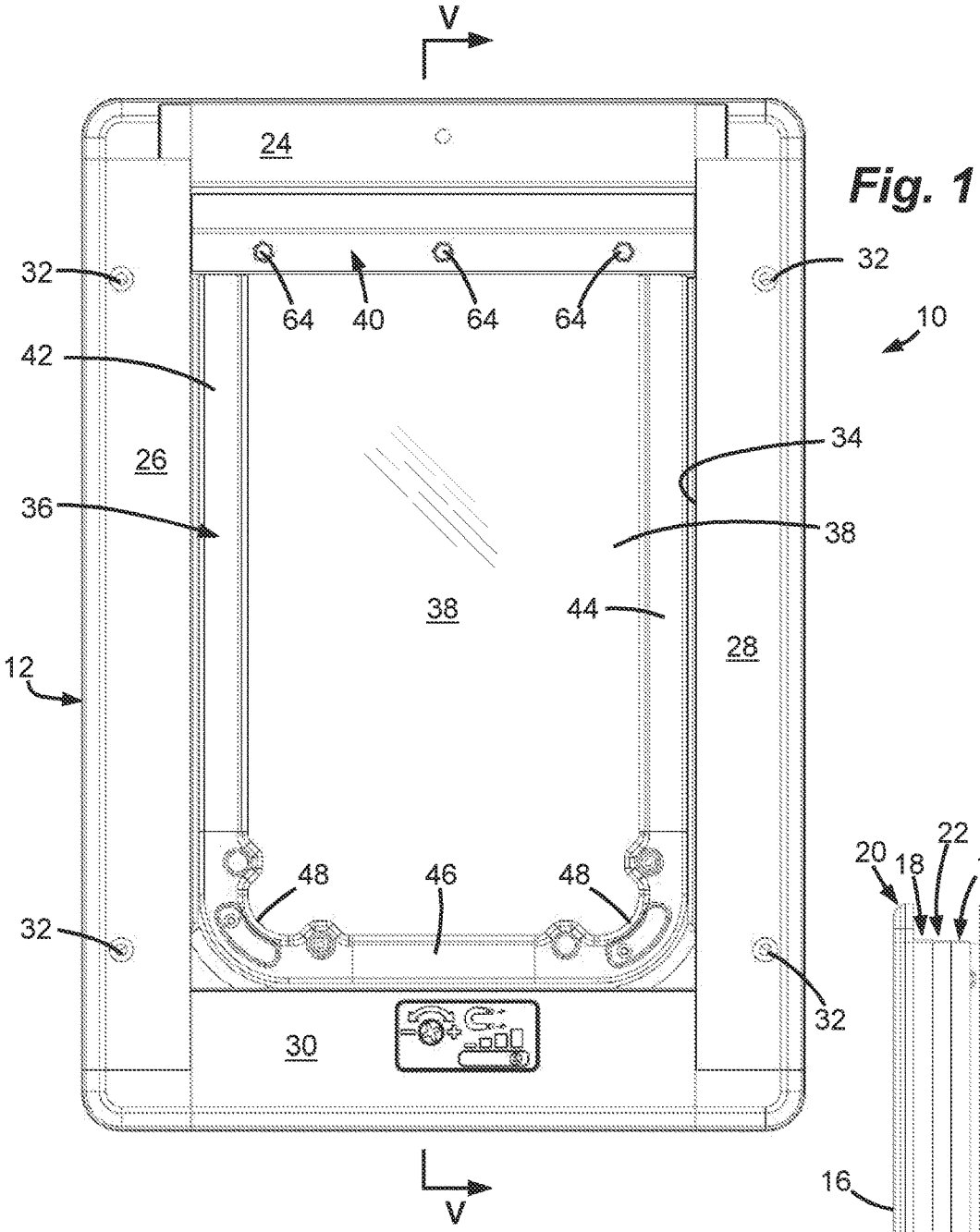
FIG. 1 is a front view of a pet door apparatus according to an embodiment of the invention.
Figure 2:
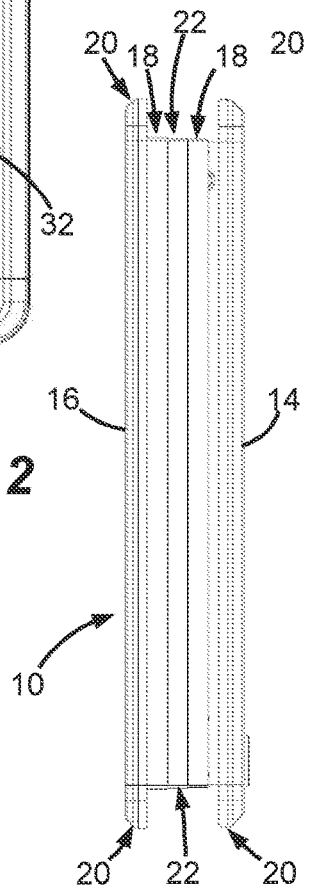
FIG. 2 is a left side view of the apparatus of FIG. 1.
Figure 3:
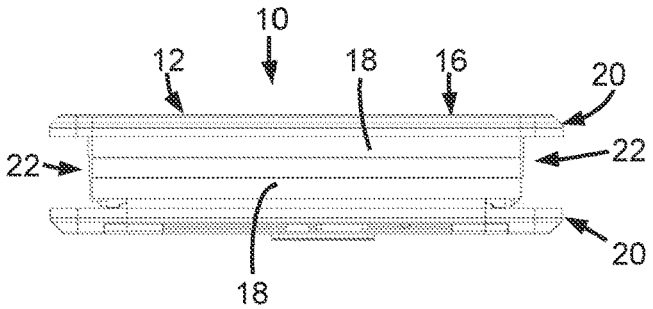
FIG. 3 is a bottom view of the apparatus of FIG. 1.
Figure 4:
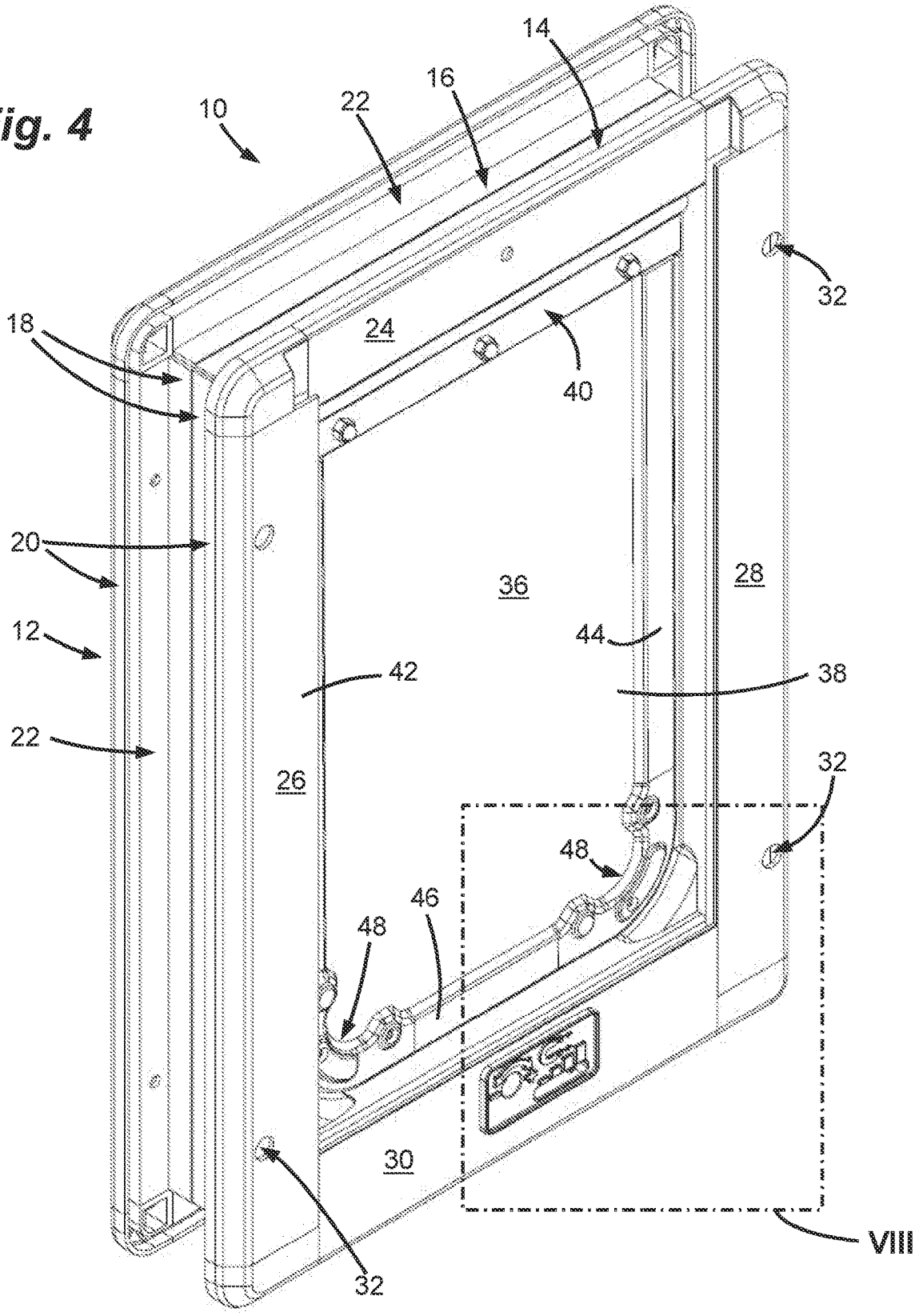
FIG. 4 is a perspective view of the apparatus of FIG. 1.

Referring to the drawings, there is shown a pet door apparatus 10 which is adapted to be mounted on a main access door (not shown) such as a hinged door, or to form part of an assembly which includes a pet door insert for a sliding door, where such doors provide access to spaces such as rooms in houses. The main door or sliding door insert has an aperture (not shown) in which, and adjacent to which, the pet door apparatus 10 can be installed.

The pet door apparatus 10 has a frame, generally referenced 12. The frame 12 has a front part 14 and a rear part 16, these parts being adapted to be connected to each other in a superimposed relationship. Each of the front part 14 and rear part 16 has a first portion 18, and a flange portion 20 which extends outwards, flange-like, relative to the first portion. Thus, the flange portions 20 of the front and rear parts 14, 16 define, between them, frame outer recesses 22.

The first portions 18 of the front and rear parts 14, 16 are of the same outer perimetral shape and dimensions as each other, and of the same shape but slightly smaller dimensions, than the aperture in the main door. Thus, when the pet door apparatus 10 is installed on the main door (in a manner not shown), the first portions 18 extend through the aperture in the main door, with the material of that main door immediately adjacent to the aperture (i.e. that defines the aperture) being received within the frame outer recesses 22, and with the flange portions 20 overlapping those portions of the main door.

The frame 12 includes a top frame portion 24, a left frame portion 26, a right frame portion 28, and a bottom frame portion 30. Each of these frame portions 24, 26, 28, 30 forms part of the front part 14 and part of the rear part 16, of the frame 12.

The frame 12 includes frame connector holes 32 which are used for receiving suitable bolts (not shown) for connecting the front part 14 and rear part 16 to each other, when the pet door apparatus 10 is installed on the main door.

The top, left, right and bottom frame portions 24, 26, 28, 30 define between them a pet door opening 34 which is adapted to allow a pet animal, such as a cat or dog, to pass through the pet door apparatus 10, and hence through the main door.

A pet flap 36 is provided for extending over, and hence effectively closing, the pet door opening 34. As described further below, the pet flap 36 is movable between a closed position in which it closes off the pet door opening 34 and an open position in which the opening is uncovered.

The pet flap 36 includes a closure sheet 38 which in a preferred embodiment is flexible, transparent and of a suitable plastics material such as polycarbonate.

The pet flap 36 further includes a top frame member 40, a left frame member 42, a right frame member 44, a bottom frame member 46, and corner portions 48.

The corner portions 48 connect the lower parts of the left and right frame members 42, 44 to the bottom frame member 46.

Figure 10:
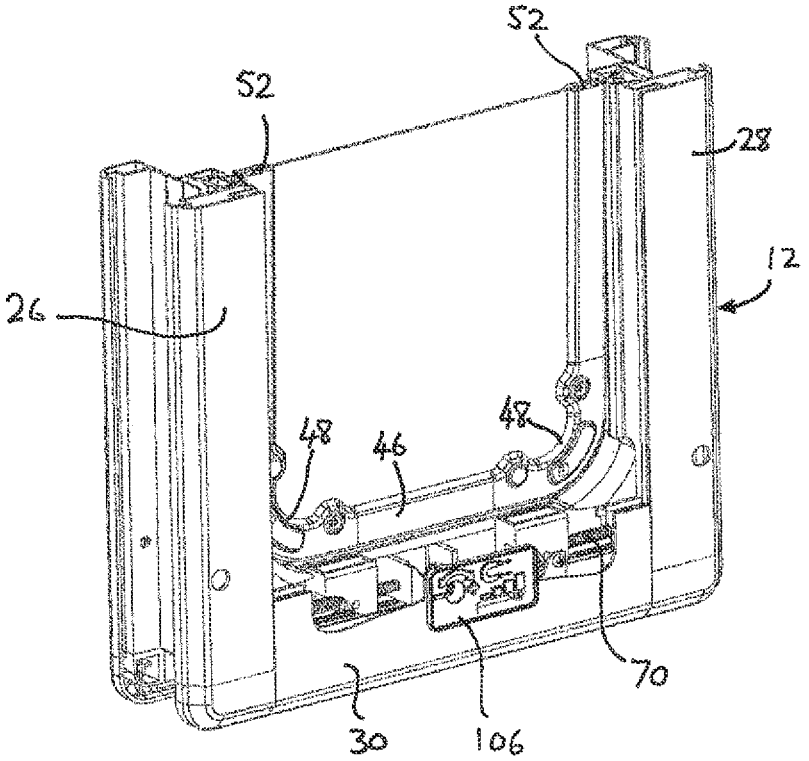
FIG. 10 is a perspective section view from the front left of the apparatus of FIG. 6, along the lines X-X.
Figure 11:
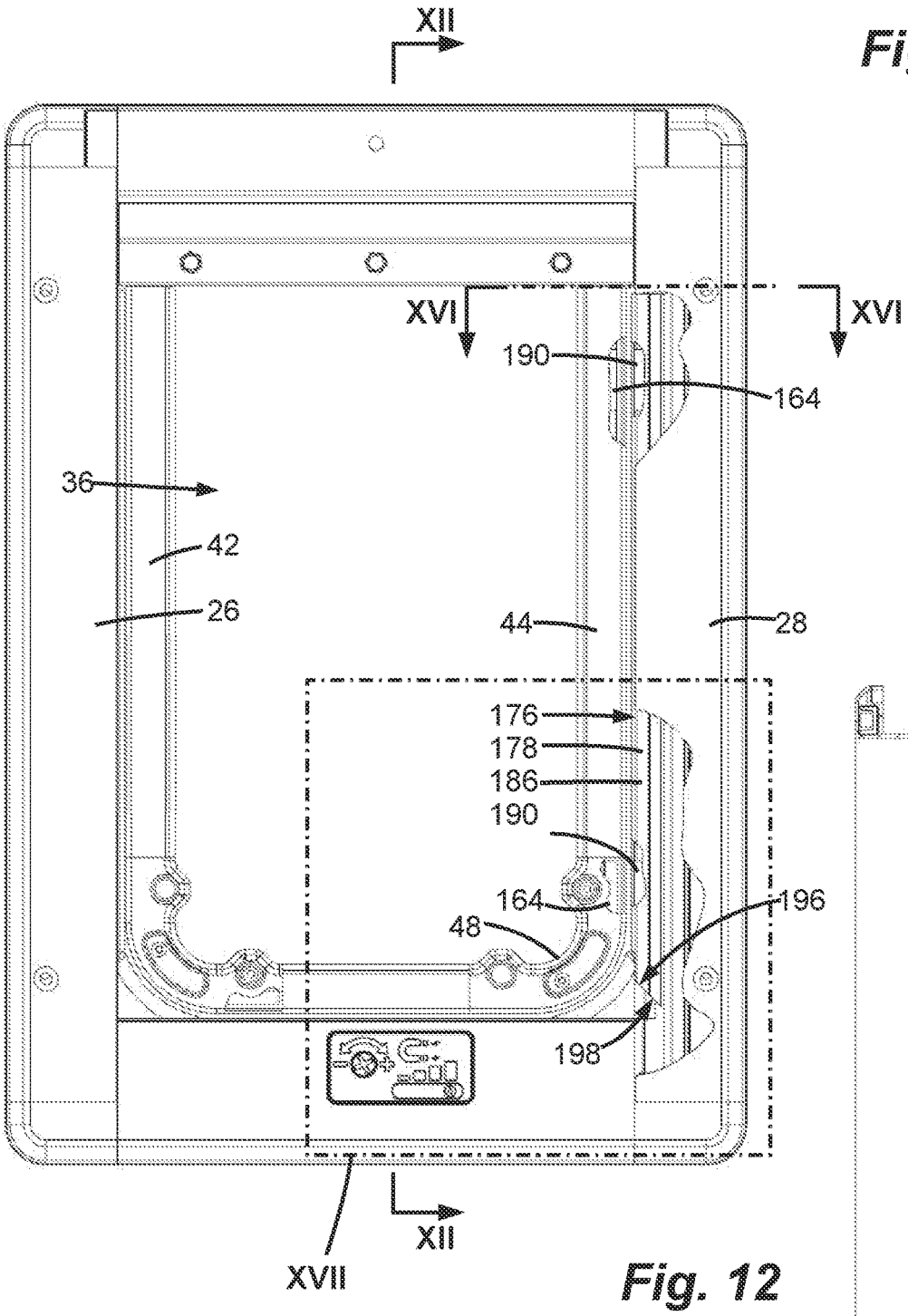
FIG. 11 is a front view of the apparatus of FIG. 1 with a right frame portion and a right pet flap portion partly cut away.
Figure 12:
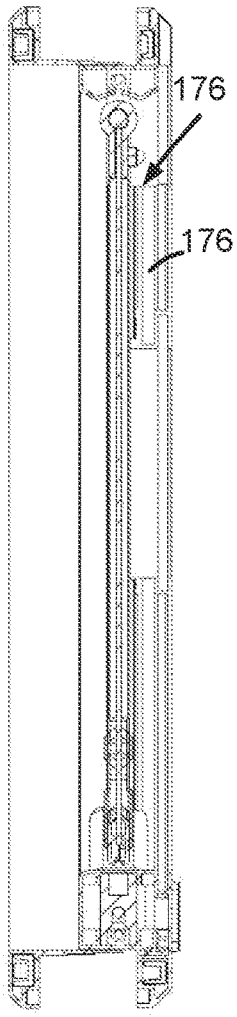
FIG. 12 is a section view of the apparatus of FIG. 11 along the lines XII-XII.
Figure 13:
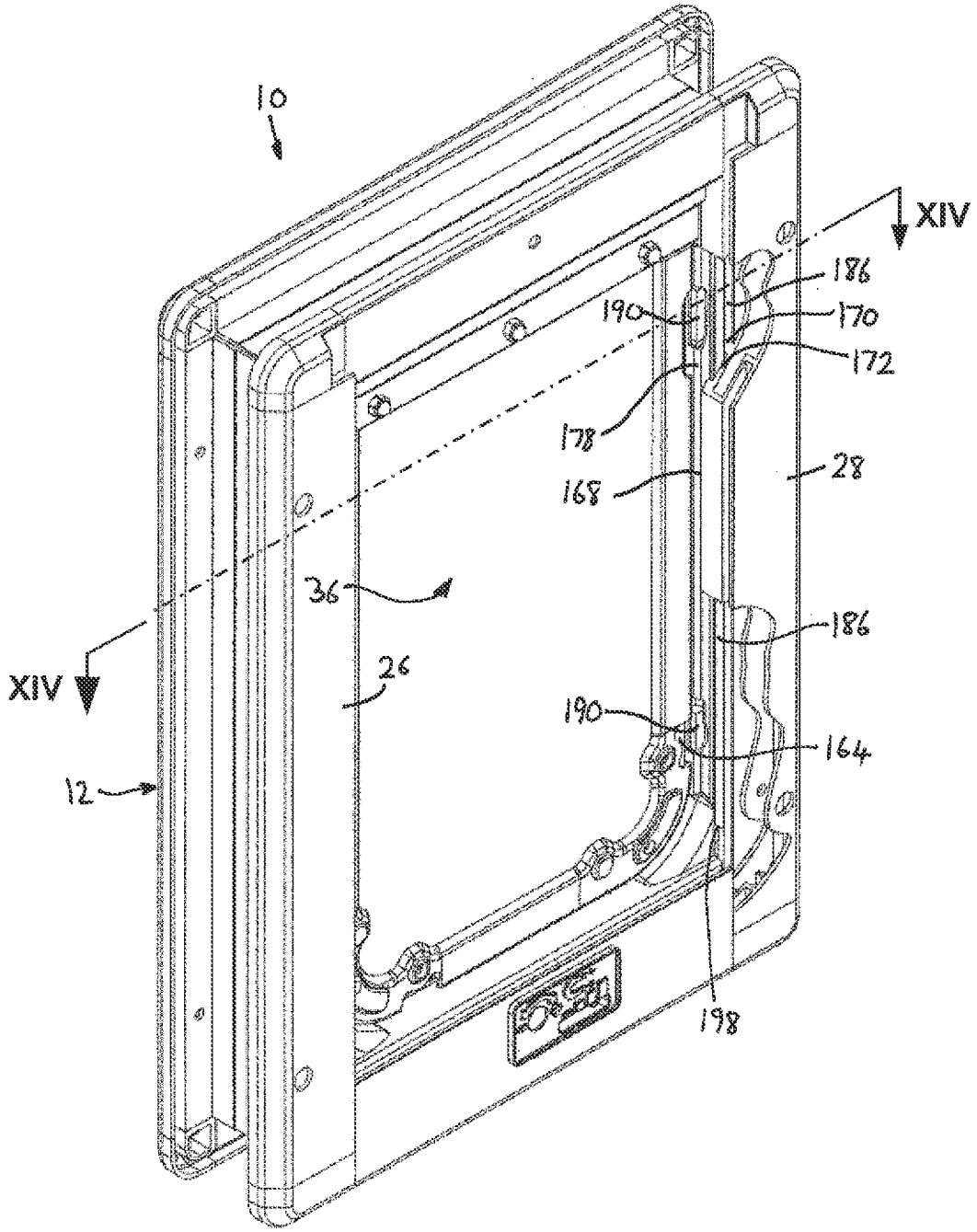
FIG. 13 is a perspective view of the apparatus as shown in FIG. 11.
Figure 14:
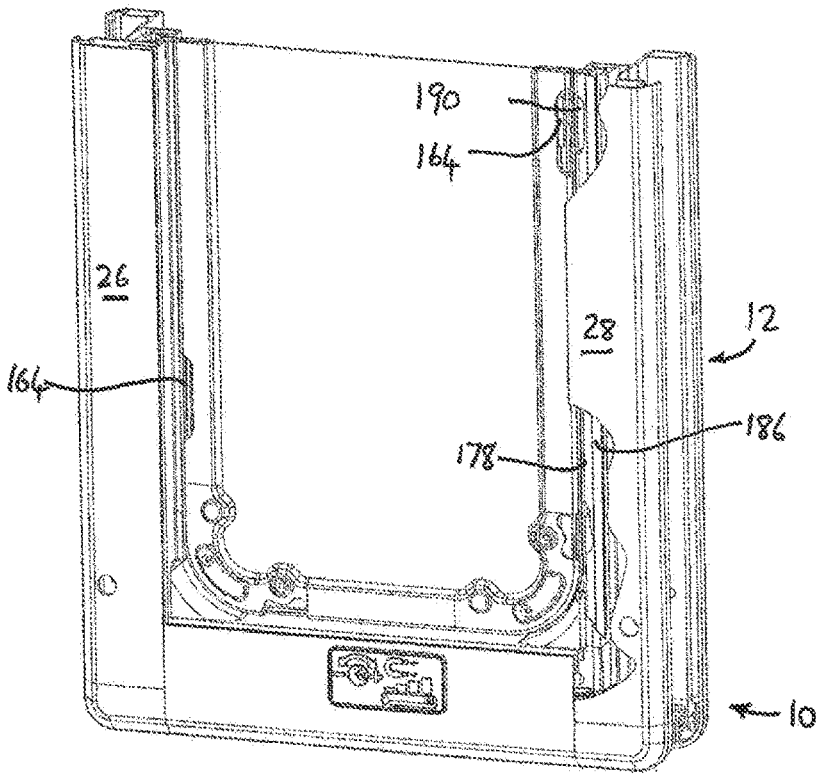
FIG. 14 is a perspective section view of the apparatus as shown along lines XIV-XIV of FIG. 13.
Figure 15:
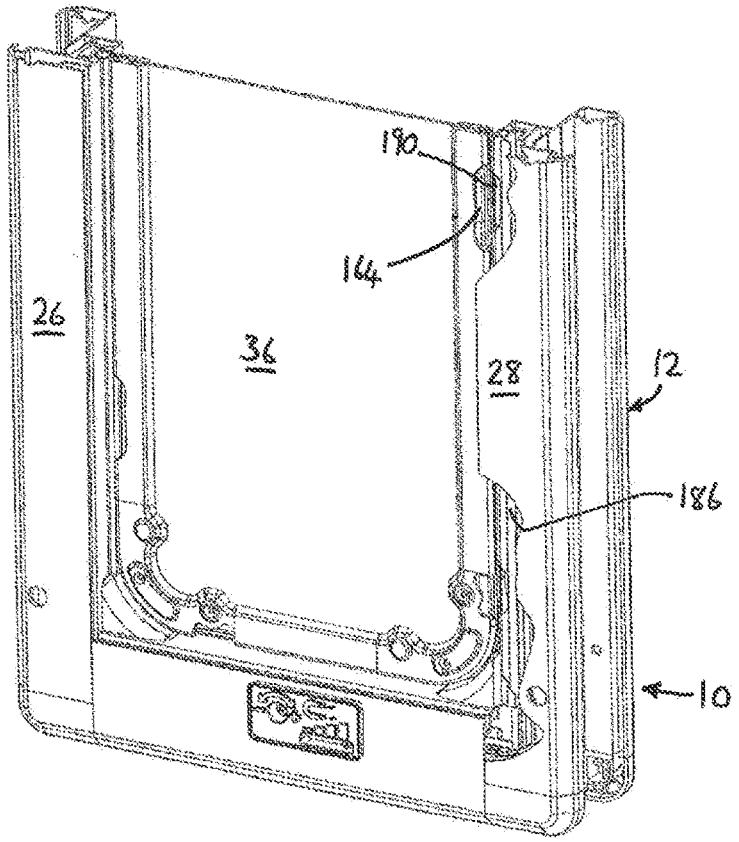
FIG. 15 is a perspective view of the apparatus as shown in FIG. 14, but at a slightly different perspective angle.

The left, right and bottom frame members 42, 44, 46 and corner portions 48 define respective recesses 52 (see especially FIGS. 5 and 10) for accommodating respective edges of the closure sheet 38.

Figure 5:
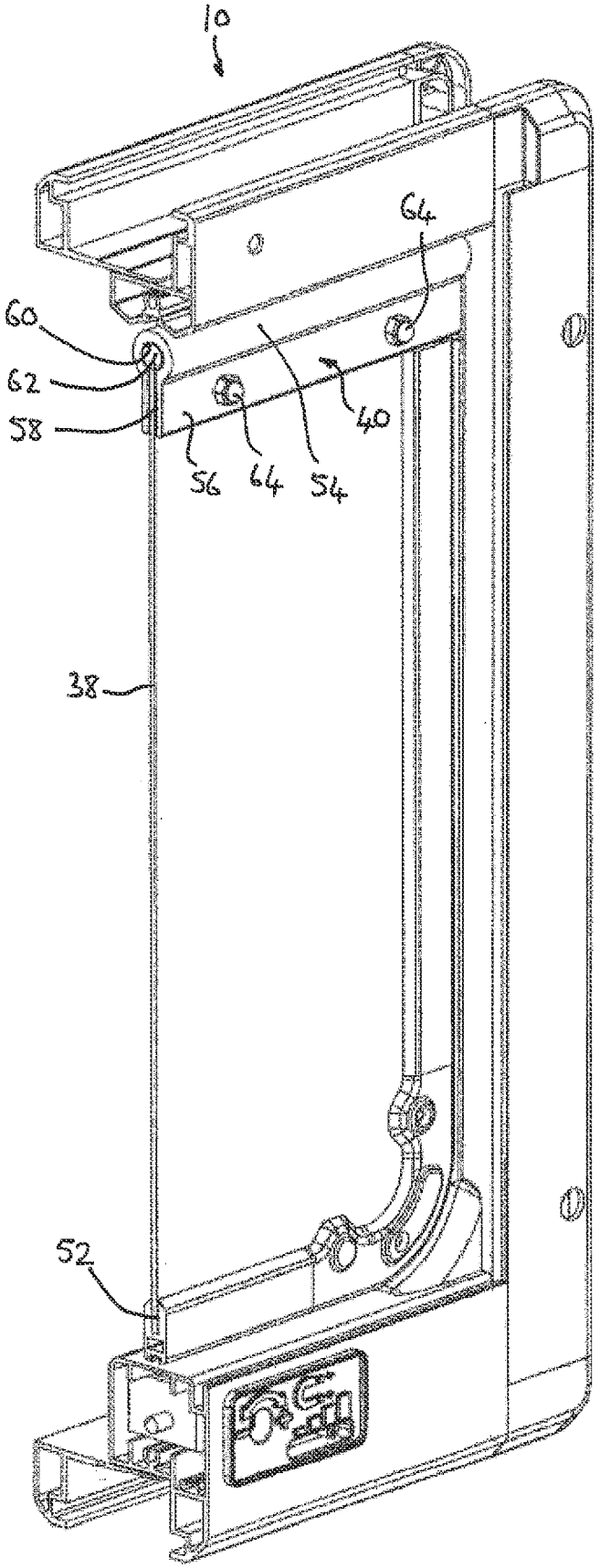
FIG. 5 is a perspective section view of the apparatus of FIG. 1, along the lines of V-V in FIG. 1.
Figure 6:
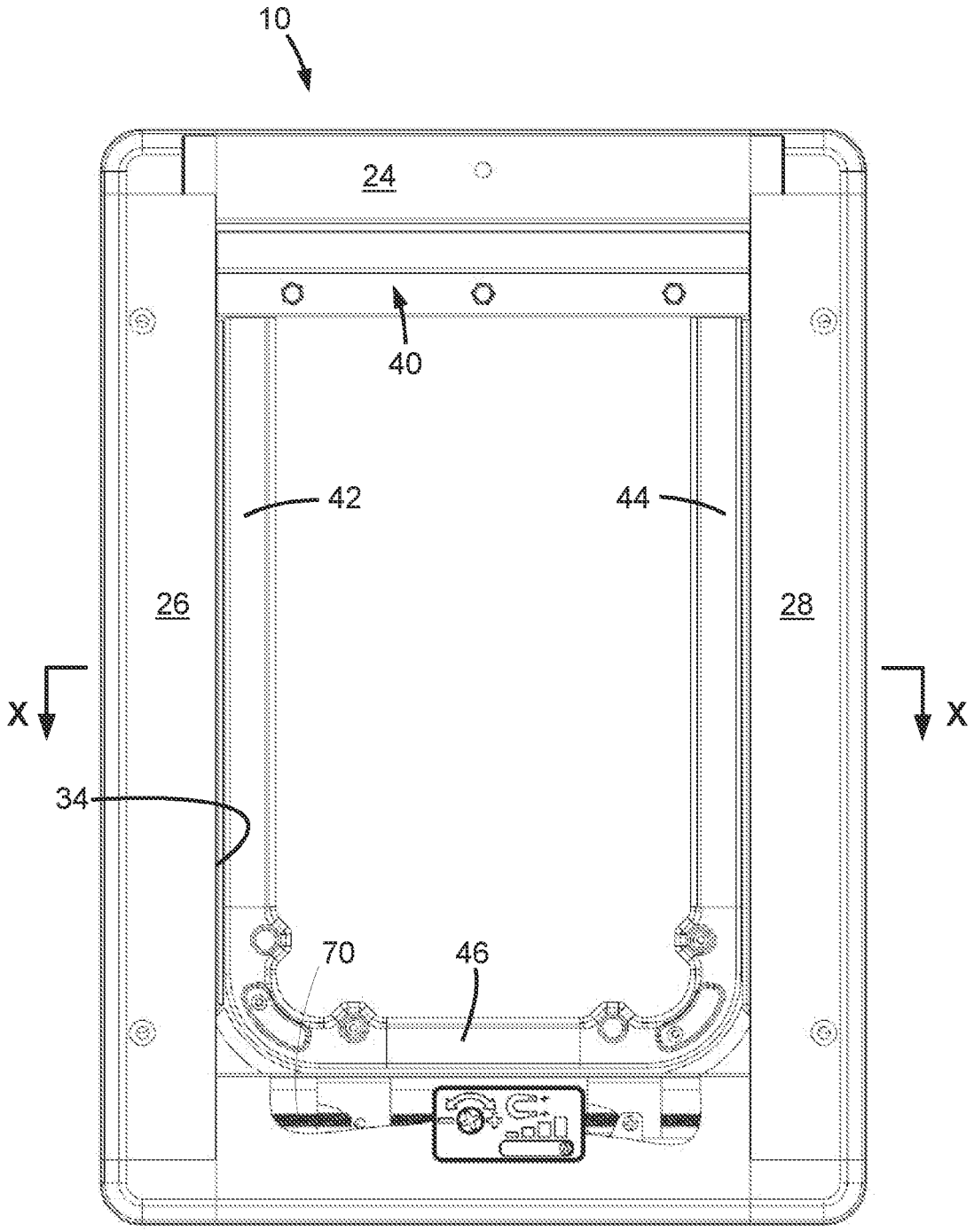
FIG. 6 is an apparatus according to FIG. 1, with a bottom frame portion thereof partially cut away.
Figure 7:
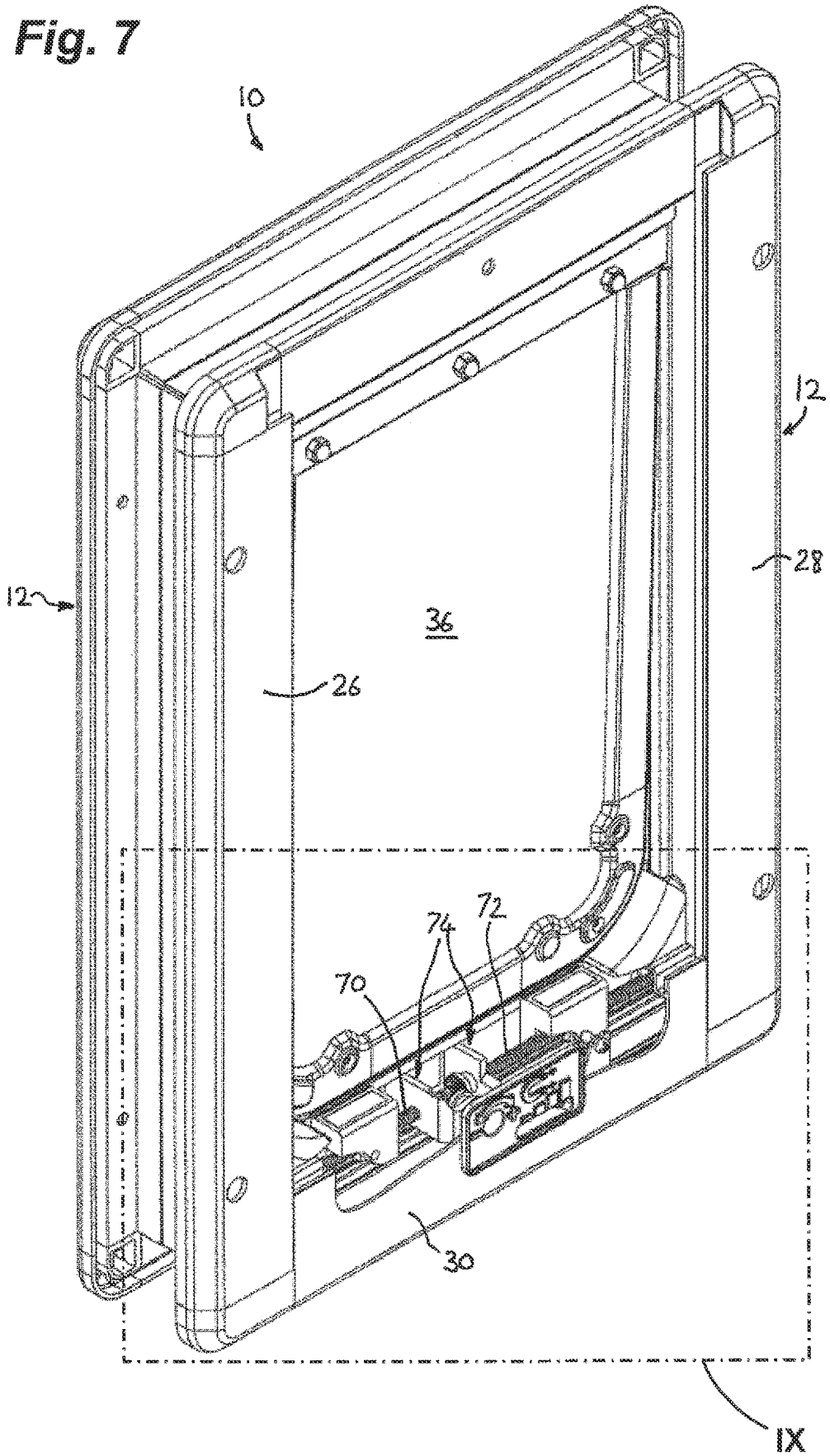
FIG. 7 is a perspective view of the apparatus as shown in FIG. 6.

As best seen in FIG. 5, the pet flat top frame member 40 includes a laterally extending tubular portion 54, and flange portions 56 extending downwards from the tubular portion. The flange portions 56 define a gap 58 between them, in which an upper edge of the closure sheet 38 is accommodated.

The tubular portion 54 defines a central passage 60 through which a rod 62 extends.

The rod 62 extends into apertures (not shown) in the left and right frame portions 26, 28 of the frame 12, so as to be rotatable therein, so that the pet flap 36 as a whole is rotatable relative to the frame.

The closure sheet 38 is firmly secured to the pet flap top frame member 40 by means of bolts 64 which extend through holes (not shown) in the flange portions 56 and top edge portion of the closure sheet.

Figure 8:
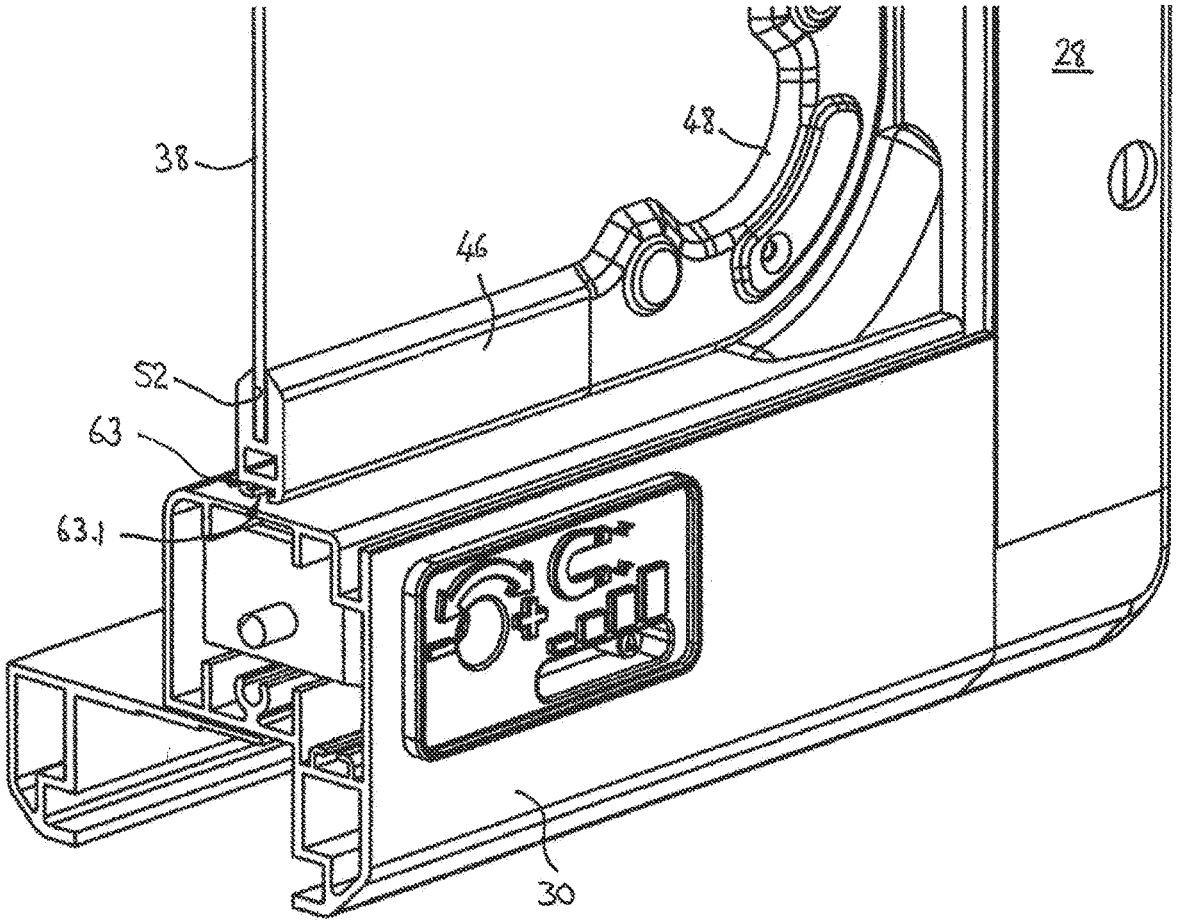
FIG. 8 is an enlarged view of the portion VIII of FIG. 4.
Figure 9:
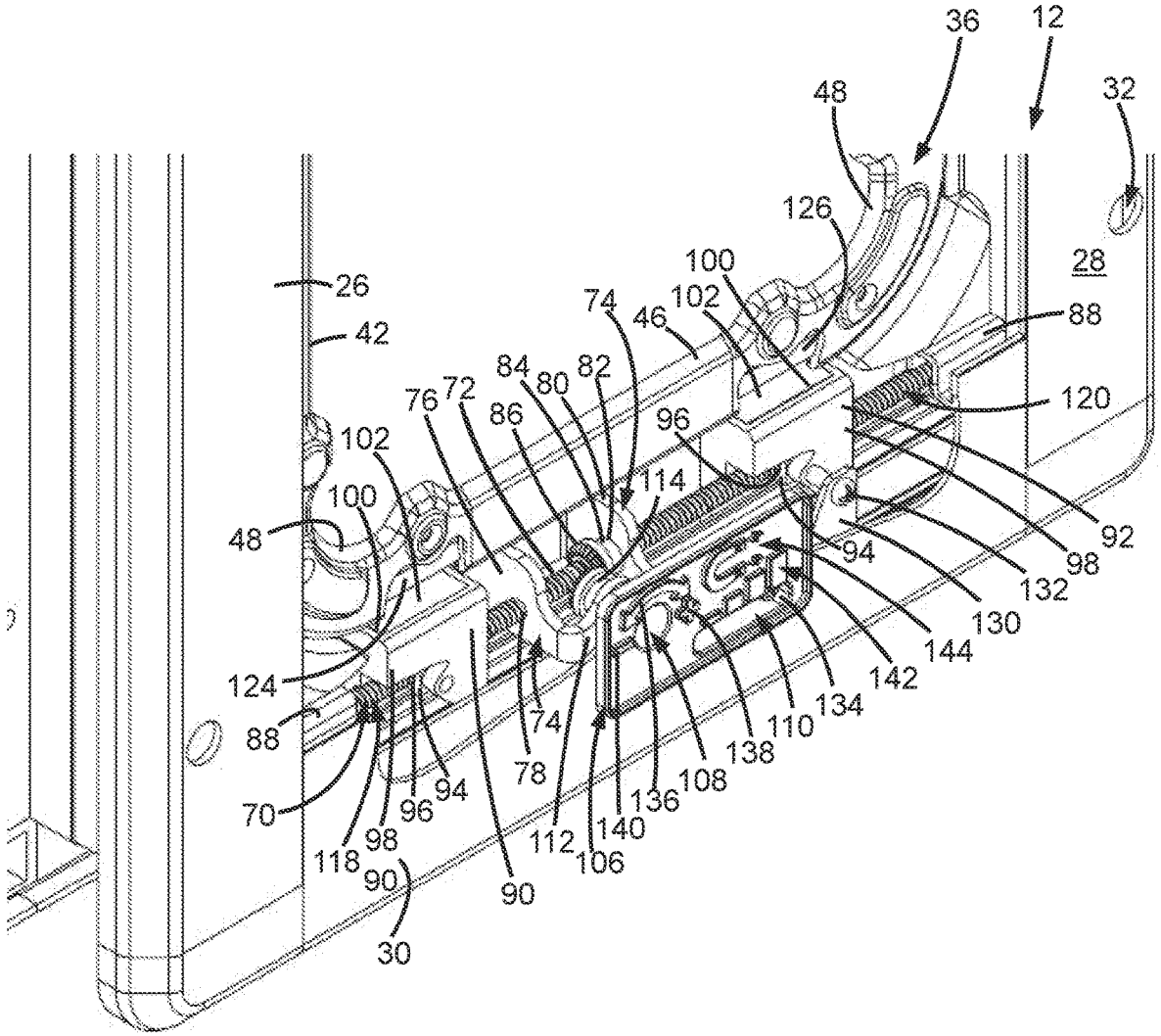
FIG. 9 is an enlarged view of the portion IX of FIG. 7.

As shown in FIG. 8, the bottom frame member 46, adjacent its lower edge, defines seal passage 63 running along the bottom of that frame member and opening out through a lowermost extremity of the frame member via a slot 63.1 running along the length of the seal passage. Similar seal passages 63 and slots 63.1 are provided on the corner portions 48 and left and right frame members 42, 44.

Suitable sealing brushes (not shown) may be accommodated within the seal passages 63 with brush fibres or strands protruding through the slots 63.1. According to a preferred embodiment, each sealing brush may include an elongate sheet accommodated and running along in the respective passage 63, the sheet being, for example, of plastics material, and having suitable fibres, preferably mohair or synthetic hair or brush, attached to it, with the fibres protruding from the respective slot 63.1.

Referring to FIGS. 6 and 7, and 9 and 10, housed within the bottom frame portion 30 of the frame 12, is a rotatable shaft 70 with an outer screw thread 72.

There is provided an inner structure 74 (see FIG. 7) having a first web portion 76 with a shaft hole 78 therein, and a second web portion 80 with a shaft hole 82 in that web portion. The rotatable shaft 70 extends through the shaft holes 78, 82 and is rotatably supported by the first and second web portions 76, 80. Attached to the rotatable shaft 70 is a first bevel gear 84 having gear teeth 86.

There is provided a first nut structure 90 and a second nut structure 92, these nut structures being mounted on the rotatable shaft 70. Each of the first and second nut structures 90, 92 includes an inner nut formation 94, having a central passage 96, which is provided with a screw thread (not shown) which is complementary to the outer screw thread 72 of the rotatable shaft 70 on which the respective nut formation 94 is located.

Each of the first and second nut structures 90, 92 further includes an outer housing 98, each housing defining a recess 100, in which is accommodated a respective magnet 102.

On a front face of the bottom frame portion 30 of the frame 12 there is provided an indicator plate 106. The indicator plate 106 defines a round aperture 108, and an elongate aperture 110.

The inner structure 74 of the bottom frame portion 30, apart from the first and second web portions 76, 78, further includes an interconnecting portion 112 which is joined to and therefore interconnects those two web portions. The interconnecting 112 portion has, rotatably mounted thereon, a second bevel gear 114 with gear teeth (not shown) which are complementary to, and adapted to engage with, the gear teeth 86 of the first bevel gear 84.

The angles of the gear teeth 86 of the first bevel gear 84 and those of the second bevel gear 114 are such that the two bevel gears are at right angles to each other, so that rotation of the second bevel gear 114 causes corresponding rotation of the rotatable shaft 70. According to a preferred example, a full revolution of the second bevel gear 114 causes a full revolution of the first bevel gear 84.

The outer screw thread 72 of the rotatable shaft 70 has a portion 118 to the left of the inner structure 74 when the pet flap 36 is viewed from the front, and a portion 120 to the right of the inner structure. Rotation of the second bevel gear 114 in a clockwise direction is adapted to cause anticlockwise rotation of the rotatable shaft 70 when it is viewed from right to left, for example in FIG. 9, and in a clockwise direction when that shaft is viewed from left to right in that figure.

Accordingly, clockwise rotational movement of the second bevel gear 114 causes the nut formation 94 of the first nut structure 90, and hence the whole of that nut structure to travel along the rotatable shaft in a direction away from the inner structure 74. Similarly, such clockwise rotational movement of the second bevel gear 114 causes the nut formation 94 of the second nut structure and hence that second nut structure 92 as a whole, to move in the same direction as the nut formation 94 of the first nut structure 90.

Located within the corner portion 48 which interconnects the left frame member 42 to the bottom frame member 46 is a first magnet 124, while a second magnet 126 is located within the corner portion 48 interconnecting the right frame member 44 to the bottom frame member 46.

It will be understood that as the second bevel gear 114 is rotated in a clockwise direction, and the first and second nut structures 90, 92 are thereby caused to move leftwards, towards the left frame portion 26, the magnets 102 mounted on those respective nut structures are moved further away from the two magnets 124, 126.

If the second bevel gear 114 is then rotated in an anticlockwise direction, this causes the first and second nut structures 90, 92, and hence the magnets 102, to move rightwards, in a direction towards the right frame portion 28, and hence into closer proximity to the respective magnets 124, 126.

In an alternative embodiment (not shown), the portion 118 of the outer screw thread 72 of the rotatable shaft 70 has a conventionally directed screw thread, while the portion 120 has a reverse screw thread. Thus, as the second bevel gear 114 is rotated in a clockwise direction, the first and second nut structures 90, 92 are thereby caused to move apart from each other further away from the two magnetics 124, 126, and if the second bevel gear 114 is then rotated in an anticlockwise direction, the first and second nut structures 90, 92 are caused to move towards each other and into closer proximity to the respective magnetics 124, 126.

The second bevel gear 114 is attached rotatably to the interconnecting portion 112 of the inner structure 74, by means of a gear shaft (not shown) which passes through a hole (most of the shaft and the hole not being shown) in that interconnecting portion, with a frontmost extremity 129 of the gear shaft having a slot or other formation (see, for example, FIG. 6) which is suitable for engagement of a tool such as a straight-edged or Phillips screwdriver, or which is suitable for another type of tool such as a hex (Allen) key or other similar tools (such other formation not being shown). Hence, such a tool can be engaged with the gear shaft so as to rotate the second bevel gear 114 in order to cause corresponding rotation of the rotatable shaft 70.

An indicator bracket 130 is connected at one of its ends, by means of a bolt 132 to the outer housing 98 of the second nut structure 92, while at the other end of the indicator bracket, there is mounted an indicator 134 in the form of a tab which protrudes partially through the elongate aperture 110 in the indicator plate 106. As the second nut structure 92 moves in a particular direction along the rotatable shaft 70 as described above, because of the indicator bracket, the indicator 134 undergoes corresponding movement within the elongate aperture 110.

In use, by rotating the second bevel gear 114 in a clockwise direction as described above, thereby moving the magnets 102 in closer proximity to the respective magnetically attractable plates 124, 126, the magnetic force exerted by those magnets on the respective magnetically attractable plates is increased, and this can assist in increasing a force urging the pet flap 36 into a closed position relative to the pet door opening 34. If the second bevel gear 114 is rotated in an anticlockwise direction, then as described above, the magnets 102 are moved further away from the respective magnetically attractable plates 124, 126 thereby decreasing the magnetic attraction between those magnets and magnetically attractable plates, and reducing the urging force that urges the pet flap 36 to the closed position relative to the pet door opening 34.

In this manner, the amount of force required to be applied to the pet flap 36 in order to move it to an opened position relative to the pet door opening 34 can be increased or decreased depending on the requirements of use. For example, if the pet door apparatus 10 is to be used in an environment in which it is subject to wind gusts, it may be beneficial to be able to increase the amount of force required to move the pet flap 36 to an opened position, so as to avoid its being undesirably opened by gusts of wind. In this case, rotation of the second bevel gear 114 in the clockwise direction may, as described above, increase the required opening force, as desired.

Conversely, if, for example, it is desired for a lesser force to be applied to the pet flap 36 in order to open it, for example if it is to be used for a small pet, the second bevel gear 114 can be rotated in an anticlockwise direction, thereby moving the magnets 102 further away from the respective magnetically attractable plates 124, 126 thereby decreasing the amount of force required to open the pet flap.

To assist a user of the pet door apparatus 10 in determining in which direction to rotate the second bevel gear 114 by means of a suitable tool to achieve the desired increase or decrease in magnetic force applied to the pet flap 36, in the preferred embodiment, indicator symbols are provided on the indicator plate 106. These indicator symbols include a bi-directional curved arrow 136, a "+" symbol 138 indicating the direction of rotation to achieve a higher magnetic force, and a "–" symbol 140, indicating the direction of rotation in order to achieve a reduced magnetic force on the pet flap 36.

Furthermore, in the preferred embodiment, a suitable symbol 142 is provided adjacent to the elongate aperture 110, to indicate, by means of the particular position of the indicator 134, whether the second bevel gear 114 has been rotated to a position at which a greater magnetic force is being applied by the magnets 102 to the respective magnetically attractable plates 126, or lesser force.

Further in the present embodiment, a magnet symbol 144 is provided to indicate, generally, that the indicator plate 106 provided for indicating magnetic force.

When the pet flap 36 is in its closed position, there may be a gap between lowermost extremity of the bottom frame member 46 and upper edge of the bottom frame portion 30 of the frame 12. The fibres described above, that protrude through the slot 63.1 at the lowermost extremity of the bottom frame member 46, can contact the upper edge of the bottom frame portion 30 so as to establish a seal or partial seal at that gap.

Figure 16:
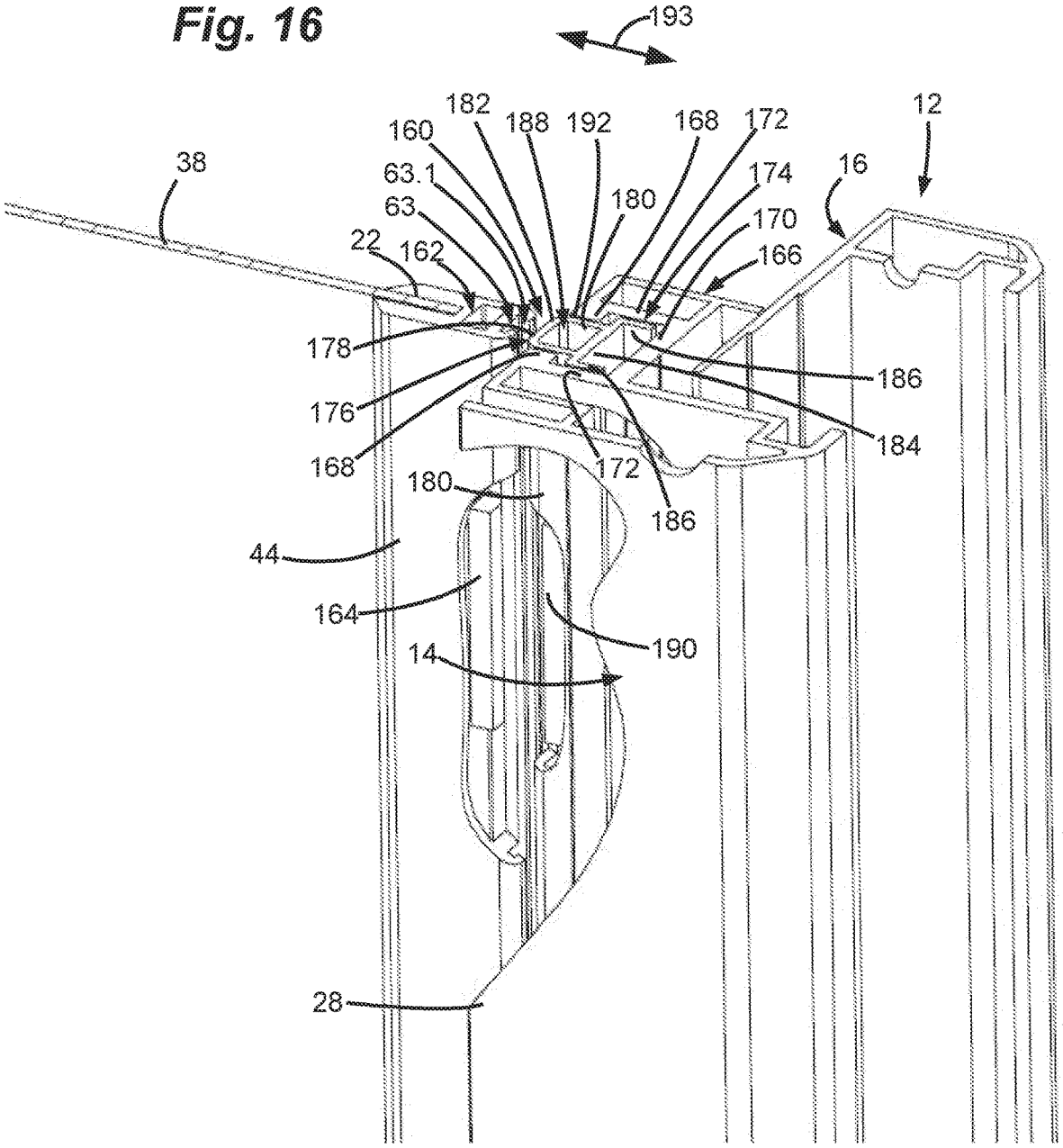
FIG. 16 is a partial perspective section view from the front top right, of the apparatus as shown in FIG. 11, along the lines XVI-XVI.

Referring to FIGS. 11 to 17, between the left and right frame members 42, 44 of the pet flap 36 and the left and right frame portions 26, 28, respectively of the frame 12, are gaps 160 (as best seen in FIG. 16).

Figure 17:
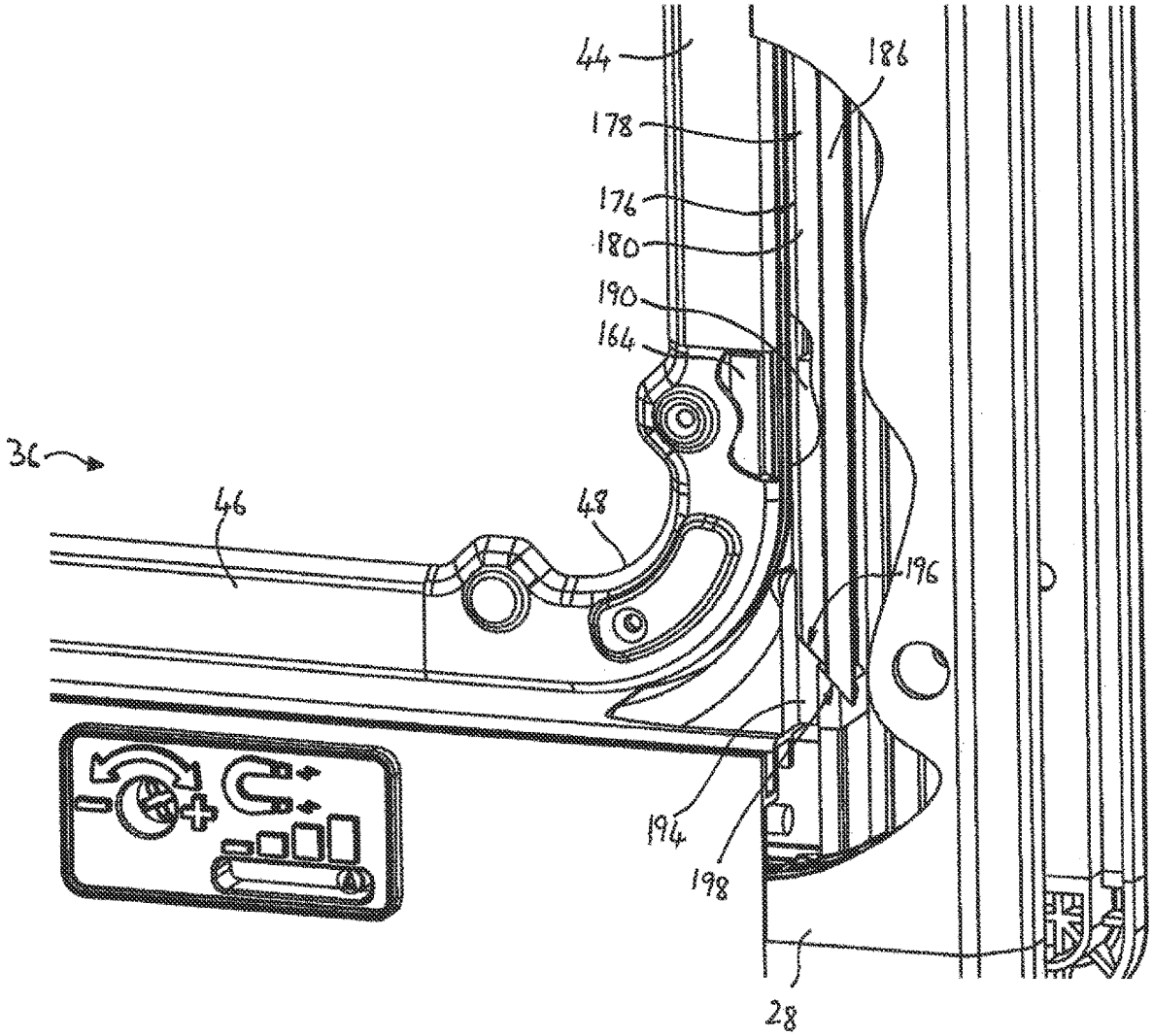
FIG. 17 is an enlarged view of the portion XVII of FIG. 11, shown in perspective view from the front right.

With reference to FIGS. 16 and 17, the right frame member 44 of the pet flap 36 and right frame portion 28 of the frame 12 are discussed in relation to the surrounding features, but it is to be understood that a similar description applies, albeit in a mirror image, to the left frame member 42 and left frame portion 26 of the frame 12, and the features surrounding it.

The right frame member 44 defines a side frame member passage 162, in which are disposed frame member magnets 164.

The right frame portion 28 of the frame 12 includes an inner recess-defining formation 166.

The formation 166 includes opposed lips 168, an opposite wall 170, and intermediate walls 172 interconnecting the respective lips and the opposite wall. The lips 168, opposite wall 170 and intermediate walls 172 define between them, a recess 174.

Accommodated within the recess 174 is portion of a movable blocking member 176. The blocking member 176 includes a protruding portion 178, which in turn includes lateral walls 180, a leading wall 182, and a trailing wall 184. The trailing wall 184 extends beyond the lateral walls 180, and is integrally joined, at its two edges, to respective projections 186, which extend, relative to the trailing wall 184, in an opposite direction to the remainder of the protruding portion 178.

As can be seen in FIG. 16, the portions of the trailing wall 184 that extend beyond the lateral walls 180, together with the respective projections 186 joined to the trailing wall, are accommodated within the recess 174.

The lateral walls 180, leading wall 182 and trailing wall 184 of the protruding portion 178 together define a blocking member passage 188 extending substantially the upward length of the blocking member 176. Disposed within the blocking member passage 188, are blocking member magnets 190, which are disposed substantially aligned to the side frame member magnets 164.

The dimension of the recess 174, between the lip 168 and opposite wall 170 thereof, is greater than the length of the respective projection 186 received therein, thus allowing movement of the blocking member 176 as a whole, relative to the right frame portion 28, towards and away from the adjacent right frame member 44 of the pet flap 36 as described further, below.

The lips 168 are shorter, in a direction from the front of the pet door apparatus 10 to the rear thereof, than the length of the opposite wall 170. Thus, the lips 168 define, between them, a slot 192 which also extends substantially the vertical length of the blocking member 176. The protruding portion 178 is dimensioned so as to be accommodated within that slot 192, so as to protrude through the slot.

If it were not for the presence of the sealing brushes (not shown) accommodated within the seal passages 63 running along the right frame member 44 (and along the corner portions 48 and left and bottom frame members 42, 46), if the blocking member 176 were moved towards the pet flap 36, it could be moved until those portions of the trailing wall 184 of the blocking member that protrude beyond the lateral walls 180 abutted the faces of the lips 168 that face inwards towards the recess 174. However, with the sealing brushes provided, before such abutting can occur, the blocking member will come into contact with the sealing brush, thus effecting at least a partial seal and limiting the extent of possible movement of the blocking member 176 in a direction towards the pet flap 36.

Thus, the blocking member 176 can adopt two extreme positions, namely an extended position in which the blocking member is moved as far as possible towards the pet flap 36, and a retracted position in which the blocking member is moved, as far as possible, away from the pet flap. When the blocking member 176 is in its extended position, the protruding portion 178 partially or completely closes the gap 160 between the right frame portion 28 of the frame 12 and the right frame member 44 of the pet flap 36. When the blocking member 176 is in its fully retracted position, it is clear of the gap 160. The direction of movement of the blocking member 176 between its fully extended and fully retracted positions are indicated by the arrow 193 in FIG. 16.

As best seen in FIG. 17, the blocking member 176 is disposed on a support formation 194. The support formation 194 has an upper face 196 which is at a slanted, acute angle to the horizontal.

The blocking member 176 has a lower face 198 which is at substantially the same angle as the upper face 196 of the support formation 194, and is adapted to be disposed on that upper face.

It will be understood that as the blocking member 176 moves between its fully retracted and fully extended positions, its lower face 198 rides along the upper face 196 of the support formation 194. Because of the angles of those faces 196, 198, as the blocking member 176 moves in this manner from its fully retracted position to it fully extended position, and as its lower face 198 rides along the upper face 196 of the support formation 194, the entire blocking member 176 is forced to move in an upward direction, against the force of gravity. Conversely, when the blocking member 176 moves from its extended position to its retracted position, it moves downwards under the effect of gravity. Thus, the upper and lower surfaces 196, 198 serve as cams.

Because of the relative positioning of the side frame member magnets 164 and blocking member magnets 190, when the pet flap 36 is in its closed position, those magnets will exert magnetic force on each other, thus urging the blocking member 176 from its retracted position to its extended position, which in turn causes the lower face 198 of the blocking member to ride along the upper face 196 of the support formation 194, causing the blocking member as a whole to move upwards as explained above.

As described above, when the blocking member 176 is in such extended position, the protruding portion 178 serves to close, at least partially, the gap 160 between the right frame member 44 of the pet flap 36 and right frame portion 28 of the frame 12.

Accordingly, when the pet flap 36 is in its closed position relative to the pet door opening 34, the magnetic force between the side frame member magnets 164 and blocking member magnets 190 keep the blocking member 176 in its extended position, such that the protruding portion 178 closes, or at least partially closes, the gap 160.

When the pet flap 36 is moved from its closed position to an open position relative to the pet door opening 34, the side frame member magnets 164 are thus moved away from the blocking member magnets 190, thereby reducing the magnetic attraction between those respective magnets, and thus releasing or reducing the magnetic force imposed on the blocking member 176 that urges it towards its extended position.

Under the urging force of gravity, and due to the angles of the engaging lower face 198 of the blocking member 176 and upper face 196 of the support formation 194, the blocking member moves downwards, thereby causing that lower face to ride, once again, along the that upper face, thereby causing the blocking member to move towards its retracted position. It will thus be appreciated that the act of closing and opening the pet flap 36 serves to cause the blocking member 176 to move towards its extended position and retracted position, respectively.

The fact that the blocking member 176 is in its retracted position when the pet flap 36 is in an open position, means that when the pet flap is then moved from its open position to a closed position relative to the pet flap opening 34, the protruding portion 178 of the blocking member 176 is withdrawn away from the gap 160 thereby preventing the pet flap, as it moves into its closed position, from colliding with the protruding portion in the event that there is some play in the location of the pet flap allowing it to undergo some lateral movement. However, once the pet flap 36 is in its fully closed position, the blocking member 176 can move, under magnetic attraction, to the extended position.

While the description relating to the blocking member 176, related components and features, and their operation is provided in relation to the right hand side of the apparatus 10 when viewed from the front (including the right frame portion 28 and right frame member 44), similar features are provided, in mirror image, and adapted for similar operation, at the left hand side of the apparatus 10 when viewed from the front (including the left frame portion 26 and left frame member 42).

Although the invention is described with reference to particular embodiments above, it is not limited to those embodiments, but may be embodied in many other forms as limited only by the claims.

For example, while the apparatus 10 is described above for use in relation to doors that provide access to spaces, it can be used in relation to windows as well.

In addition, the pet flap 36 may be rigid or flexible, at least in areas of the flap where such flexibility is not prevented or limited by the particular features as described above.

Where reference is made to magnets and magnetically attractable elements on which those magnets can act, in other embodiments those components may be swapped around in relative position.

In this specification, reference to the prior art is not intended, and is not to be construed, as any suggestion or admission that such prior art forms part of the common general knowledge in Australia or anywhere else.

The invention claimed is:

1. A pet door apparatus including:

a pet door frame defining a pet door opening;

a closure flap rotatably mounted on the pet door frame, the closure flap being rotatable between a closed position in which the flap closes at least part of the pet door opening and an open position in which the closure flap is at least partly spaced from the pet door opening;

a magnet;

a magnetically attractable element; and an actuator;

wherein the magnet is mounted on one of the closure flap and the pet door frame and the magnetically attractable element is mounted on the other of the closure flap and the pet door frame wherein the magnet and magnetically attractable element are adapted to exert a magnetic attraction force on each other when the closure flap is in its closed position, wherein one of the magnet and magnetically attractable element is movable by the actuator, relative to the one or other of the closure flap and the pet door frame to which it is mounted, whereby, said one of the magnet and magnetically attractable element is moveable by the actuator relative to the other of said magnet and magnetically attractable element while the closure flap remains in its closed position, so as to change the distance between the magnet and magnetically attractable element and thereby to change the magnetic attraction force.

2. The pet door apparatus of claim 1 wherein said actuator is a linear actuator adapted to move said one of the magnet and magnetically attractable element linearly.

3. The pet door apparatus of claim 2 wherein the linear actuator includes a shaft having a first screw thread, and a nut formation having a second screw thread complementary to the first screw thread and said one of the magnet and magnetically attractable element is mounted to the shaft via the nut formation, whereby rotation of the shaft is adapted to cause relative rotation between the first screw thread and second screw thread thereby causing linear movement of the nut formation and said one of the magnet and magnetically attractable element along the shaft such that said one of the magnet and magnetically attractable element moves relative to the other of the magnet and magnetically attractable element when the closure flap is in its closed position.

4. The pet door apparatus of claim 1 including an actuator controller adapted to cause movement of at least a part of actuator to effect movement of said one of the magnet and magnetically attractable element.

5. The pet door apparatus of claim 4 wherein said at least a part of the actuator includes the nut formation, and the actuator controller is adapted to cause movement of the nut formation along the shaft to effect said movement of said one of the magnet and magnetically attractable element.

6. The pet door apparatus of claim 4 wherein the controller is manually operable.

7. The pet door apparatus of claim 6 wherein the controller is manually operable by means of a manually operable tool applied to the controller.

8. The pet door apparatus of claim 1 including an indicator device for providing a visual indication which represents a relative positioning between said one of the magnet and magnetically attractable element and other of the magnet and magnetically attractable element.

9. A pet door apparatus including:

a pet door frame defining a pet door opening, the frame having a side frame component;

a flap rotatably mounted on the pet door frame, the flap being rotatable between a closed position in which the flap closes at least part of the pet door opening such that there is a gap between the flap and the side frame component, and an open position in which the flap is at least partly spaced from the pet door opening;

a blocking member attached to the side frame component so as to be movable relative to the side frame component between an extended position in which at least a portion of the gap is closed by the blocking member, and wherein the blocking member is in a vertically upper position, and a retracted position in which less than said portion of the gap is closed by the blocking member, and wherein the blocking member is in a vertically lower position, the blocking member being adapted to move from the vertically lower position to the vertically upper position when moving from the retracted position to the extended position and to move from the vertically upper position to the vertically lower position when moving from the extended position to the retracted position, wherein gravitational force urges the blocking member towards its vertically lower position so as to urge the blocking member towards its retracted position;

a magnet; and a magnetically attractable element, wherein the magnet is mounted to a first portion of the pet door apparatus and the magnetically attractable element is mounted to a second portion of the pet door apparatus, wherein one of the first portion and second portion is on the flap adjacent to the gap when the flap is in the closed position, and the other of the first portion and second portion is on the side frame component adjacent to the gap, wherein, when the flap is moved into in the closed position, the magnet and the magnetically attractable element are adapted for a first magnetic attraction force to be exerted between them, the first magnetic attraction force being sufficient to overcome the urging of the blocking member towards its vertically lower, retracted position by said gravitational force, thereby to cause the blocking member to move from its vertically lower position to its vertically upper position and from its retracted position towards its extended position, and wherein, when the flap is in its open position, the magnet and the magnetically attractable element are adapted for at most a second magnetic attraction force to be exerted between them, the second magnetic attraction force being less than the first magnetic attraction force and being insufficient to overcome the urging of the blocking member towards its vertically lower, retracted position by said gravitational force, whereby the blocking member is adapted for said gravitational force to move the blocking member towards is vertically lower, retracted position.

10. The pet door apparatus of claim 9 wherein the side frame component includes a first cam surface and the blocking member includes a second cam surface, said cam surfaces being adapted, when the first magnetic attraction force causes the blocking member to move from its lower vertical position and retracted position towards its upper vertical position and extended position, for the second cam surface to ride along the first cam surface thereby to cause said the blocking member to undergo upward movement from the lower vertical position towards the upper vertical position.

11. The pet door apparatus of claim 9 wherein, when the blocking member is in the extended position, the whole of the gap is closed by the blocking member.

12. The pet door apparatus of claim 9 wherein, when the blocking member is in the retracted position, substantially no portion of the gap is closed by the blocking member.

13. The pet door apparatus of claim 10 wherein the blocking member is elongate and the second cam surface is disposed adjacent to a lower end of the blocking member.

14. The pet door apparatus of claim 9 wherein the side frame component includes a support formation positioned below the blocking member and on which the blocking member is disposed, the support formation defining the first cam surface.

15. The pet door apparatus of claim 9 wherein the blocking member has a base portion and a protruding portion and the side frame component defines a slot, wherein the blocking member, when in its extended position, is adapted for the protruding portion to protrude from the slot into the gap by a first length, and is adapted for the protruding portion to be retracted relative to the first length when the blocking portion is in its retracted position.

16. The pet door apparatus of claim 1 wherein the magnetically attractable element is a magnet.

17. The pet door apparatus of claim 9 wherein the magnetically attractable element is a magnet.

* * * * *